US008235495B2

(12) United States Patent
Okada

(10) Patent No.: US 8,235,495 B2
(45) Date of Patent: Aug. 7, 2012

(54) PRINTER

(75) Inventor: Yoshiyuki Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 180 days.

(21) Appl. No.: 12/797,937

(22) Filed: Jun. 10, 2010

(65) Prior Publication Data

US 2010/0315452 A1 Dec. 16, 2010

(30) Foreign Application Priority Data

Jun. 12, 2009 (JP) ..... P2009-141048

(51) Int. Cl.
*B41J 29/38* (2006.01)

(52) U.S. Cl. ..... 347/17

(58) Field of Classification Search ..... 347/5, 7, 347/17
See application file for complete search history.

(56) References Cited

U.S. PATENT DOCUMENTS 5,992,991 A * 11/1999 Kanemoto et al. ..... 347/88

FOREIGN PATENT DOCUMENTS

JP 2008023806 2/2008

* cited by examiner

*Primary Examiner* — An Do
(74) *Attorney, Agent, or Firm* — The Nath Law Group; Jerald L. Meyer

(57) ABSTRACT

A print head includes an ink propelling mechanism, an ink tank supplies ink to the print head, an ink circulation route includes the print head and the ink tank therein, a pump circulates ink through the ink circulation route, a temperature sensor measures a temperature of ink flowing in a route between the print head and the ink tank in the ink circulation route, a heater is disposed in a vicinity of the ink tank to heat ink, and a controller works with a received print job, operating for temperatures of ink as measures at the temperature sensor lower than a first prescribed reference, to heat ink by the heater without starting printing, and for temperatures of ink as measures at the temperature sensor kept equal to or higher than the first reference for a prescribed time interval, to start printing.

6 Claims, 7 Drawing Sheets

PRINTER

BACKGROUND OF THE INVENTION

1. Field of the Invention

The present invention relates to a printer of ink circulation type, and particularly to an acquirement of temperatures of ink and a printing control based thereon.

2. Description of Related Arts

There has been spread use of inkjet printers including print heads for propelling ink droplets to make a print on a print sheet. In inkjet printers, print heads have had their ink propelling mechanisms configured with arrays of piezoelectric devices or such for propelling ink droplets in accordance with applied drive voltages. For use in inkjet printers, there have been various kinds of ink available with a typical property tending to have increased viscosities under low-temperature environments, constituting a difficulty to secure adequate droplet amounts. To this point, there has been a patent literature 1 (Japanese Patent Application Laid-Open Publication No. 2008-23806) describing a warm-up of ink in a low temperature state, with a pause of print until an arrival at an adequate ink temperature. Further, there has been practical use of inkjet printers configured with an ink circulation route therein to circulate ink for a further enhanced printing reliability.

FIG. 1 shows a configuration of combination of an inkjet head 130 and an ink circulation system 150 of a conventional ink circulation type inkjet printer. As shown in the figure, the inkjet head 130 includes ink chambers 131, ink propelling mechanisms 132, and a temperature sensor 133. The temperature sensor 133 is adapted to measure a representative ink temperature of the ink chambers 131 directly or indirectly.

The ink circulation system has a looped ink circulation mute, and includes a replaceable ink cartridge 210, a downstream tank 220, a pump 260, a cooler 250, a heater 240, and an upstream tank 230. The upstream tank 230 has a temperature sensor 231 disposed therein to measure an ink temperature. It is noted that the present figure is illustrated for only one color ink. When the inkjet printer is provided with a number of different color inks, it has an ink cartridge 210, an inkjet head 130, a downstream tank 220, an upstream tank 230, a temperature sensor 231, and the like provided for each color.

The ink cartridge 210 supplies ink, which is temporarily stored in the downstream tank 220 installed downstream of the inkjet head 130. Then, ink is delivered by the pump 260 from the downstream tank 220 to the upstream tank 230, where it is supplied to the ink chambers 131 in the inkjet head 130, where it is used for a printing. Unused ink in the inkjet head 130 is returned again to the downstream tank 220.

The heater 240 is disposed in a vicinity of the upstream tank 230, and the cooler 250 is disposed between the downstream tank 220 and the upstream tank 230. The heater 240 is adapted to warm up ink when the ink temperature is low, which is measured by the temperature sensor 231 disposed in the upstream tank 230. The cooler 250 is configured with a heat sink and an air fan, for instance, and adapted to cool ink when the ink temperature is high.

SUMMARY OF THE INVENTION

As described, when the ink temperature is lower than an adequate temperature, the heater 240 is operated to warm up ink with a pause of print until an ink temperature of ink flowing into the inkjet head 130 becomes the adequate temperature.

As an ink temperature of ink flowing into the inkjet head 130, employed in the past was an estimation based on a measure of the temperature sensor 231 in the upstream tank 230. This is because of stored ink in the upper tank 230 to be supplied to the inkjet head 130.

However, the upper tank 230 has a mixture of ink flowing from the downstream tank 220 and already pooled therein, thus resulting in uneven ink temperatures. This prevents an ink temperature of ink flowing into the inkjet head 130 from being estimated with precision. Accordingly, there is the need of setting a wider margin of temperature for a determination whether or not the ink temperature is raised up to the adequate temperature by heating. For example, when the lower limit of an adequate temperature range is 20° C., a printing cannot be started until a measure of the temperature sensor 231 becomes 25° C.

From the view point of user usability, it is preferable to have a shorter waiting time for a start of printing in a low temperature state. It is an object of the present invention to provide a printer of ink circulation type allowing for a reduced waiting time for a start of printing due to an ink heating in a low temperature state.

To achieve the object, a printer according to the present invention comprises: a print head including an ink propelling mechanism; an ink tank configured to supply ink to the print head; an ink circulation route including the print head and the ink tank therein; an ink circulator adapted to circulate ink through the ink circulation route; a first temperature sensor adapted to measure a temperature of ink flowing in a route between the print head and the ink tank in the ink circulation route; a heater disposed in a vicinity of the ink tank to heat ink; and a controller configured to work with a received print job, operating for temperatures of ink as measures at the first temperature sensor lower than a first prescribed reference, to heat ink by the heater without starting printing, and for temperatures of ink as measures at the first temperature sensor kept equal to or higher than the first reference for a prescribed time interval, to start printing, wherein the prescribed time interval is defined based on: a distance between the first temperature sensor and the print head; a cross-sectional area of the route between the print head and the ink tank; and an ink circulation amount per unit time in the route between the print head and the ink tank.

DETAILED DESCRIPTION OF PREFERRED EMBODIMENTS

Figure 1:
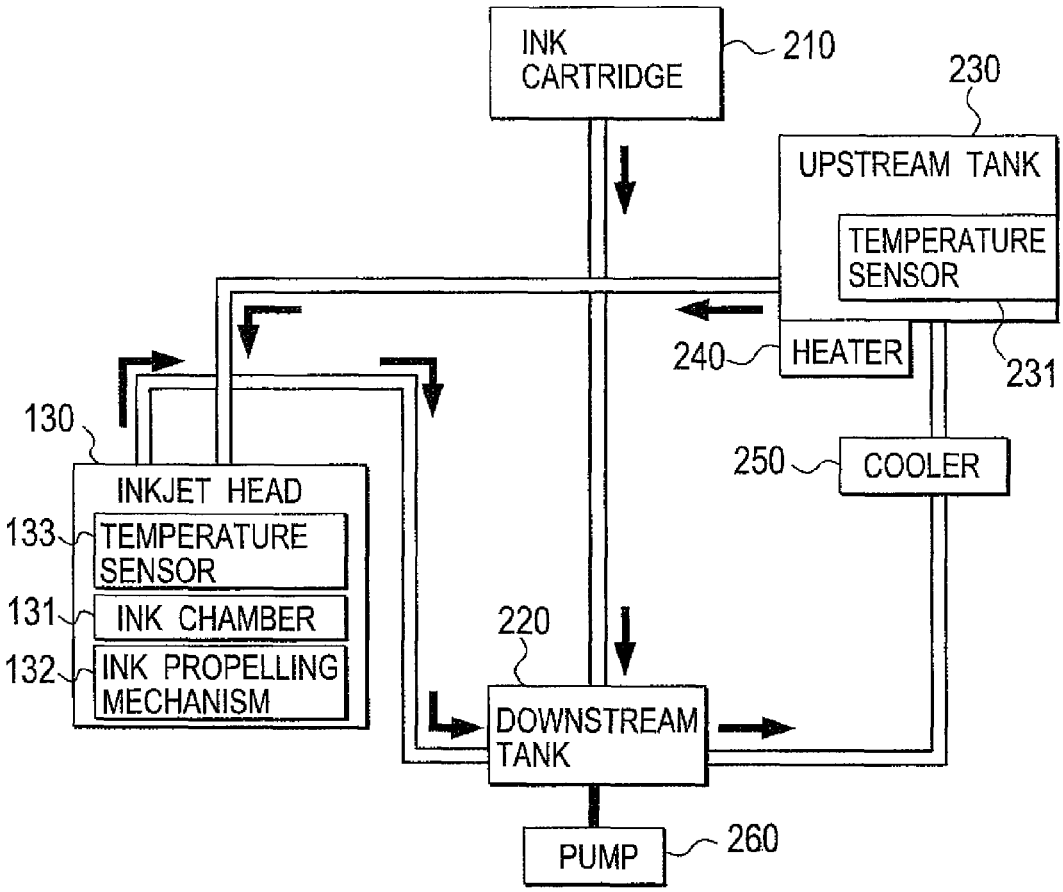
FIG. 1 is a block diagram of configuration of combination of an inkjet head and an ink circulation system of a conventional ink circulation type inkjet printer.
Figure 2:
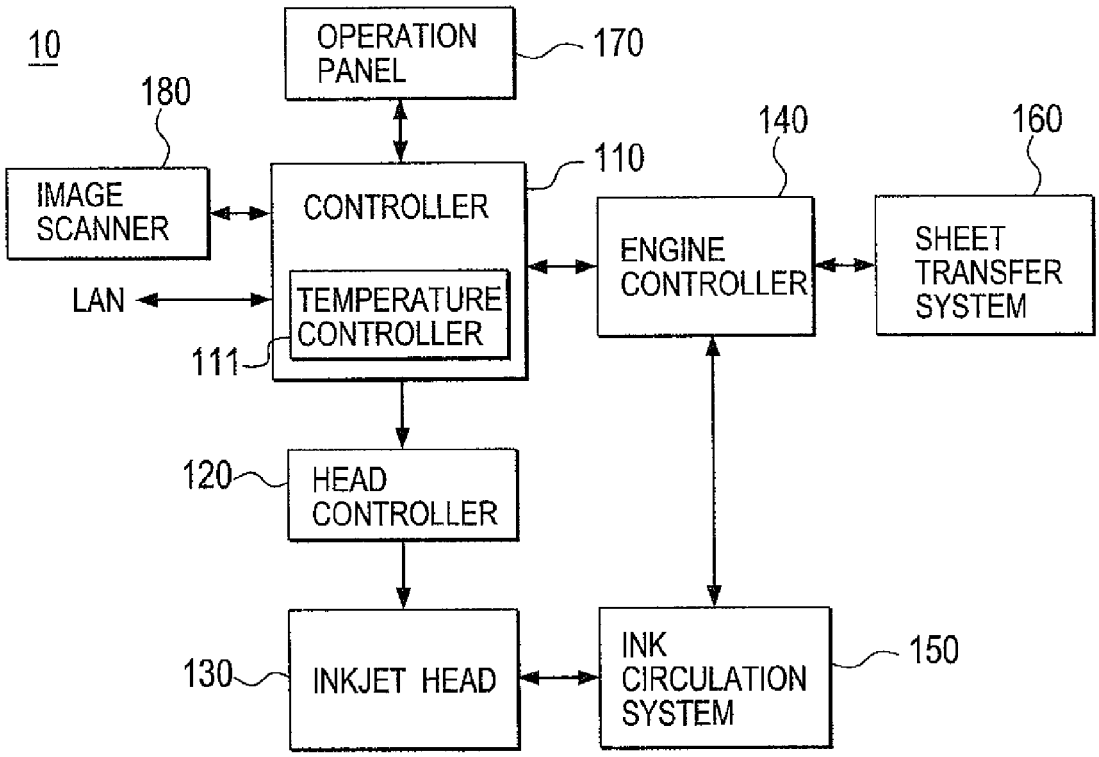
FIG. 2 is a block diagram of entire configuration of an inkjet printer according to an embodiment of the present invention.

Description is now made of an embodiment of the present invention, with reference to associated drawings. FIG. 2 is a block diagram of entire configuration of an inkjet printer 10 according to this embodiment. As shown in the figure, the inkjet printer 10 includes a controller 110, a head controller 120, an inkjet head 130, an engine controller 140, an ink circulation system 150, a sheet transfer system 160, an operation panel 170, and an image scanner 180.

The controller 110 includes, among others, a controller substrate provided with a CPU, memories, etc. for image processing, print job control, and the like. In other words, it implements a sequence of processes including a process of generating ink discharge data based on an image frame to be printed, to output to the head controller 120. The image frame to be printed may be a set of image data scanned by the image scanner 180, or a set of print data transmitted from a PC through a LAN.

Further, the controller 110 includes a temperature controller 111 configured to control ink temperatures in the inkjet printer 10. The temperature controller 111 employs a temperature sensor to measure an ink temperature. When the ink temperature is low, the controller 111 does not start printing, but employs a heater to warm up ink When the ink temperature becomes an adequate temperature, the controller 111 starts printing. The controller 111 employs a temperature sensor disposed at a position appropriate for a more precise estimation of a temperature of flux of ink flowing into the inkjet head 130, to measure an ink temperature.

The head controller 120 is configured to generate a set of drive signals, to output to the inkjet head 130, for driving the inkjet head 130 in accordance with a set of ink discharge data input from the controller 110. The set of ink discharge data may be a set of data on ink droplet numbers per pixel in a cell or line of image, for instance.

The inkjet head 130 is configured with multiple nozzles, and has behind each of them an ink chamber to store ink therein, and an ink propelling mechanism to discharger or propel ink out of the ink chamber through the nozzles. In this embodiment, the ink propelling mechanism has a piezoelectric element for causing the ink chamber to change shape, to propel a droplet of ink through the nozzle. Hence, the ink propelling mechanism has, besides the piezoelectric element, a driver for driving the piezoelectric element in accordance with a signal output from the head controller 120. There may be use of an ink propelling mechanism with a heating element for heating ink, to produce bubbles, to eject ink.

The ink circulation system 150 includes an ink mute of circulation type, a pump, a heater, a cooler, and a temperature sensor or thermometer, etc. In the ink circulation system 150, ink is circulated along the ink route, and supplied to ink chambers in the inkjet head 130. For the inkjet printer 10, provision of the ink circulation system 150 permits an effective removal of impurities in ink. The sheet transfer system 160 includes, among others, feed and discharge mechanisms, and drives such as motors and rollers for sheet feed, transfer, and discharge.

The engine controller 140 is configured to control the ink circulation system 150 and the sheet transfer system 160. Specifically, it controls the pump included in the ink circulation mechanism 150, and the feed and discharge mechanisms and rollers, etc. included in the sheet transfer system 160, to execute necessary processes for ink circulation, ink temperature control, etc.

The operation panel 170 is configured to accept user operations, to inform the controller 110 of the contents. It may be a display of touch-panel type. The image scanner 180 is configured to optically scan an original, for a conversion into a set of image data to be output to the controller 110.

Figure 3:
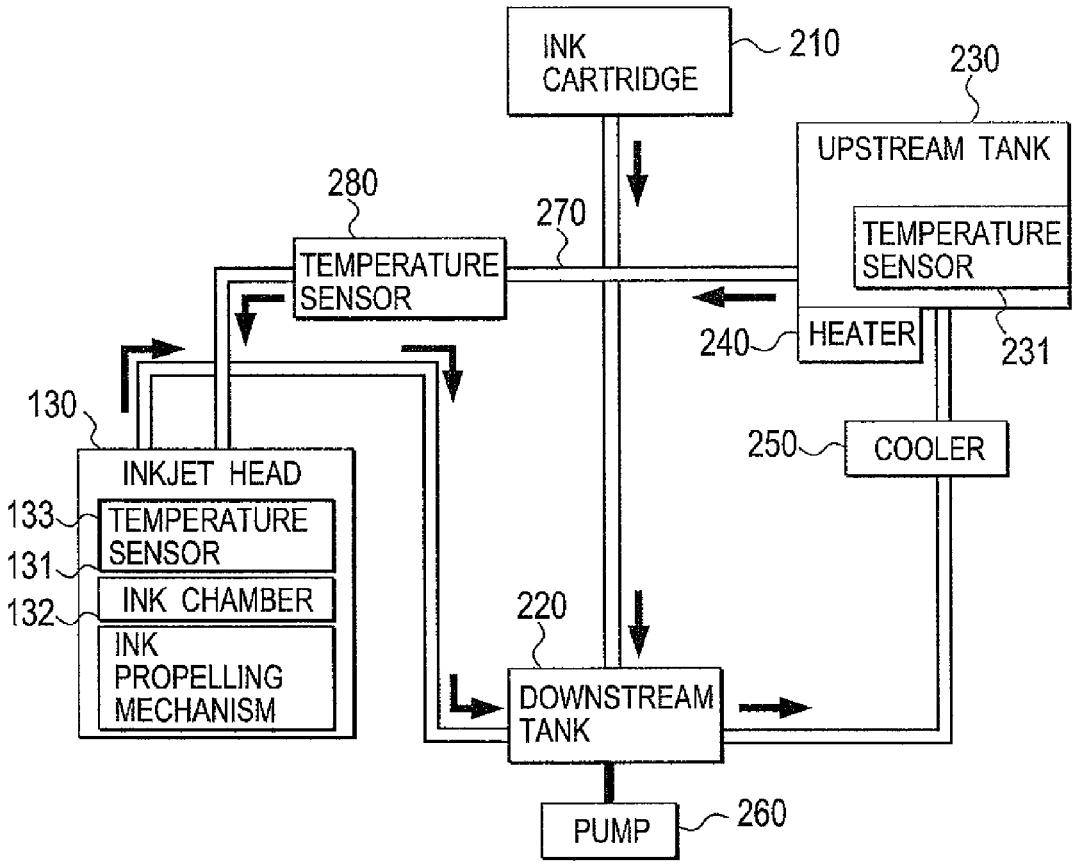
FIG. 3 is a block diagram of configuration of combination of an inkjet head and an ink circulation system according to the embodiment.

FIG. 3 shows in a block diagram a representative configuration of combination of an inkjet head 130 and an ink circulation system 150. With respect to the ink circulation type inkjet printer in the past, like elements and functions are designated by like reference characters. As shown in the figure, the inkjet head 130 includes ink chambers 131, ink propelling mechanisms 132, and a temperature sensor 133. The temperature sensor 133 is adapted to measure a representative ink temperature of the ink chambers 131 directly or indirectly.

The ink circulation system 150, like the conventional ink circulation type inkjet printer, has a looped ink circulation route, and includes a replaceable ink cartridge 210, a downstream tank 220, a pump 260, a heater 240, a cooler 250, and an upstream tank 230. The upstream tank 230 has a temperature sensor 231 disposed therein to measure an ink temperature. It is noted that the present figure is addressed for one color ink. When the inkjet printer has a number of different color inks, it has an ink cartridge 210, an inkjet head 130, a downstream tank 220, an upstream tank 230, a temperature sensor 213, and the like provided for each color ink.

The ink cartridge 210 supplies ink, which is temporarily stored in the downstream tank 220 installed downstream of the inkjet head 130. Then, ink is delivered by the pump 260 from the downstream tank 220 to the upstream tank 230, where it is supplied for distribution to the ink chambers 131 in the inkjet head 130, where it is used for a printing. Unused ink in the inkjet head 130 is returned again to the downstream tank 220. With consume of ink for printing, a corresponding quantity of ink is supplied from the ink cartridge 210 to the downstream tank 220.

The inkjet head 130 is disposed at a higher level than the downstream tank 220, and the upstream tank 230 is disposed at a still higher level than the inkjet head 130. This positional relationship provides head differences assisting the supply of ink from the upstream tank 230 to the inkjet head 130, and the return of ink from the inkjet head 130 to the downstream tank 220.

The heater 240 is disposed in a vicinity of the upstream tank 230, and the cooler 250 is disposed between the downstream tank 202 and the upstream tank 230. The heater 240 is adapted to heat ink when the ink temperature is low, which is measured by the temperature sensor 231 disposed in the upstream tank 230. The cooler 250 is configured with a heat sink and an air fan, for instance, and adapted to cool ink when the ink temperature is high. The temperature controller 111 is adapted to control these operations.

In the present embodiment, there further is a temperature sensor 280 disposed in an ink route 270 which interconnects the upstream tank 230 and the inlet head 130, to measure an ink temperature of flux of ink flowing through the ink route 270. Along the ink route 270, ink is circulated to flow without stagnation. The temperature sensor 280 is thus adapted to detect an ink temperature of flux of ink flowing into the inkjet head 130 with a favorable precision.

That is, there are given values of: a distance between the temperature sensor 280 and the inkjet head 130; a sectional area of the ink route 270; and an ink flow rate per unit time during an ink circulation period. This permits flux of ink with a temperature detected at the temperature sensor 280 to arrive at the inkjet head 130 by an estimable time.

More specifically, ink with an ink temperature detected at the temperature sensor 280 arrives at the inlet head 130 after a time interval of $D1 \times L1/V1$, where D1 is a sectional area of the ink route 270; L1 a distance between the temperature sensor 280 and the inkjet head 130; and V1 an ink flow rate per unit time during an ink circulation period. It is noted that V1 may be defined by combination of an amount of ink circulation with the pump 260 and an amount of ink consumption at the inkjet head 130. In this case, the amount of ink consumption can be calculated in accordance with a maximum print ratio, for instance.

Figure 4:
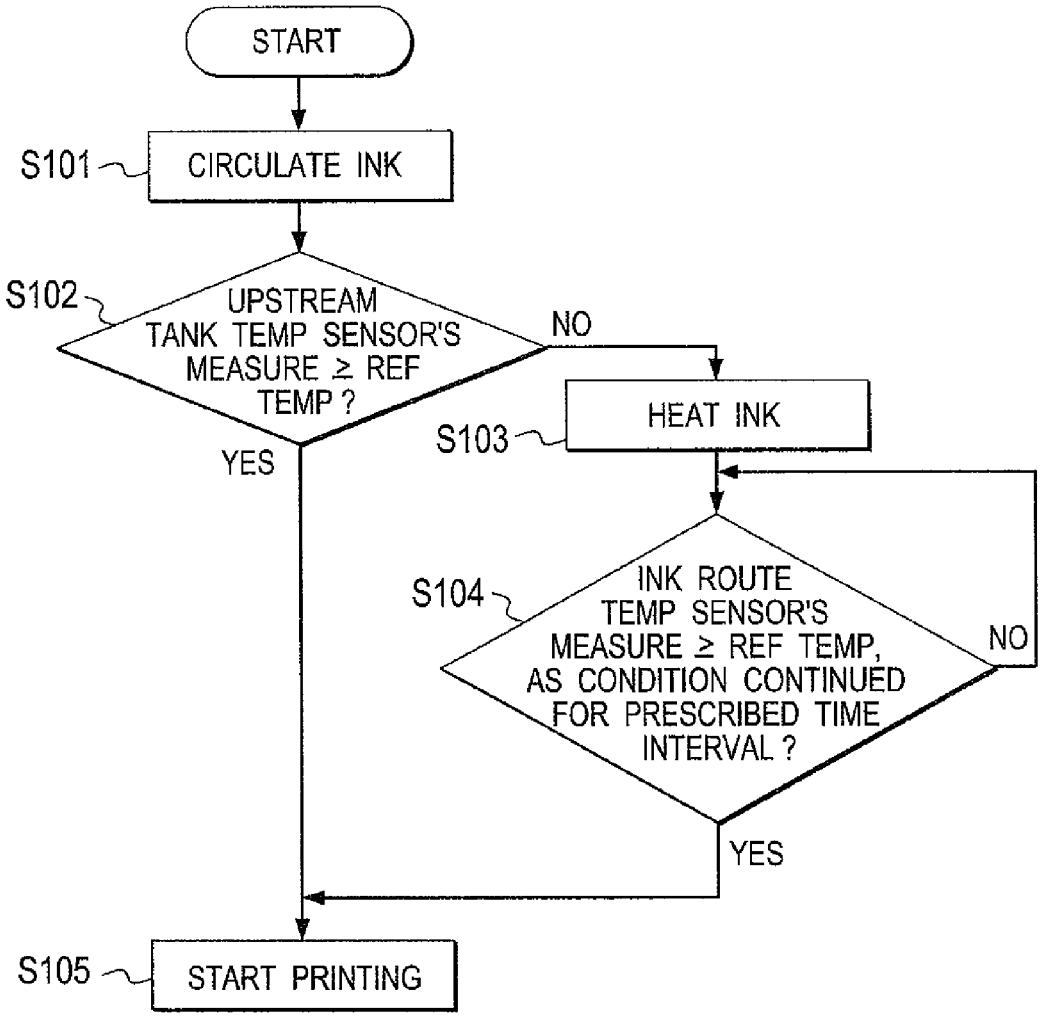
FIG. 4 is a flowchart of control actions in a startup of a printing by the inkjet printer.

Description is now made of control actions in a startup of a printing by the inkjet printer 10 according to the present invention, with reference to a flowchart in FIG. 4. There will be eliminated redundancy in description associated with an adequate ink temperature range or higher. The following actions can be applied to every color ink to be used in a printing.

The present actions are started with a reception of print job. The reception of print job may be, among others, a reception of print data from a PC, such as through a LAN, or user operation accepted through the operation panel 170 for a printing of a set of image data scanned by the image scanner 180.

The inkjet printer 10 circulates ink prior to a start of printing (S101). The engine controller 140 operates the pump 260 to circulate ink in a direction from the downstream tank 220 to the upstream tank 230 to the inkjet head 130 to the downstream tank 220. It is noted that the ink circulation may also be implemented in a continuous waiting phase.

The temperature sensor 111 monitors the temperature sensor 231 disposed in the upstream tank 230, and determines whether or not an ink temperature detected at the temperature sensor 231 is a prescribed reference temperature or more (S102). The reference temperature can be a value corresponding to a lower limit of an adequate ink temperature range.

If the ink temperature detected at the temperature sensor 231 is the reference temperature or more (Yes at the step S102), there is an eliminated need of heating ink, thus permitting a start of printing (S105). There may be a further consideration of a measure of the temperature sensor 133 in the inkjet head 130, to start a printing.

On the other hand, if the ink temperature measured at the temperature sensor 231 is lower than the reference temperature (No at the step S102), the temperature controller 111 operates the heater 240 to heat ink (S103).

In the ink heating phase, the temperature controller 111 monitors measures of ink temperatures at the temperature sensor 280 disposed between the upstream tank 230 and the inkjet head 130. Then, it determines whether or not there is a continuous state in which measures of ink temperatures are kept at a reference temperature or more, for a prescribed time interval (S104). The reference temperature can be a value corresponding to a lower limit of an adequate ink temperature range, and thus the same value with that in the step S102. It is noted that there may be a consideration of a temperature drop during a travel of ink from the temperature sensor 280 to the inkjet head 130, etc., to define another reference temperature.

Figure 6A:
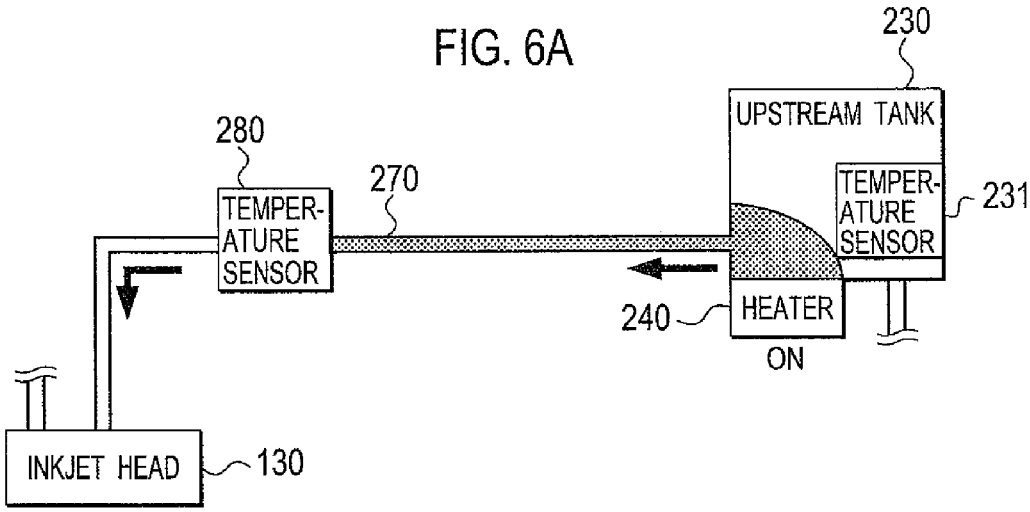
FIGS. 6A, 6B, and 6C are diagrams of ink temperatures in the startup of printing.

FIG. 6A shows an arrival of ink to the temperature sensor 280, which is heated by the heater 240 up to the reference temperature or more. In the present figure, a shaded part shows flux of ink heated by the heater up to the reference temperature or more, and a white part shows flux of ink with temperatures lower than the reference temperature. In the present state, flux of ink to be supplied to the inkjet head 130 is lower than the reference temperature, thus preventing a printing from being started.

The prescribed time interval can be given by the above-noted D1×L1/V1. That is, the time interval is a time necessitated for flux of ink with a temperature detected at the temperature sensor 280 to arrive at the inkjet head 130. Accordingly, a continuous state in which measures of ink temperatures are kept at a reference value or more for a time interval of D1×L1/V1, permits a supply of flux of ink to the inkjet head 130, at a temperature equal to the reference temperature or more. This allows for an ensured arrival of ink with a temperature raised up to a reference temperature at the printing head at a start of printing.

To allow for an ensured propelling of ink droplets at a reference or higher temperatures, there may be a consideration of volume of the ink chambers 131 in the inkjet head 130. That is, there is an amount of ink having the reference temperature or more to fill the ink chambers 131 with expectation, after a time interval of ICV/V1 from an arrival of the ink to the inkjet head 130, where the volume of ink chambers 131 is ICV Therefore, the prescribed time interval defined by D1×L1/V1+ICV/V1 permits a highly ensured propelling of ink droplets at the nozzles at the reference temperature or more. Or, the distance L1 may be a distance between the temperature sensor 280 and the nozzles of the inkjet head 130.

There is the volume ICV of ink chambers 131, the ink flow rate V1, or the like, to be taken into consideration to define a prescribed time interval with flexibility. For specific examples, when the ink chambers 131 are relatively wide, thus having a possibility of uneven ink temperatures therein, etc, the volume of ink chambers 131 is taken into consideration to define the prescribed time interval by D1×L1/V1+ICV/V1. On the other hand, when the ink chambers 131 are relatively narrow, thus permitting an assumption of a highly uniform temperature therein, or if a printer having a faster ink circulation rate is employed, there is an almost eliminated influence of volume of ink chambers 131. Accordingly, the prescribed time interval can be defined by D1×L1/V1. In either case, an adequate amount of margin can be defined.

In this regard, if there is a continuous state for the prescribed time interval, in which ink temperatures are kept at a reference value or more (Yes at the step S104), a printing is started (S105). There may be a further consideration of a measure at the temperature sensor 133 in the inkjet head 130 to start a printing.

Figure 6B:
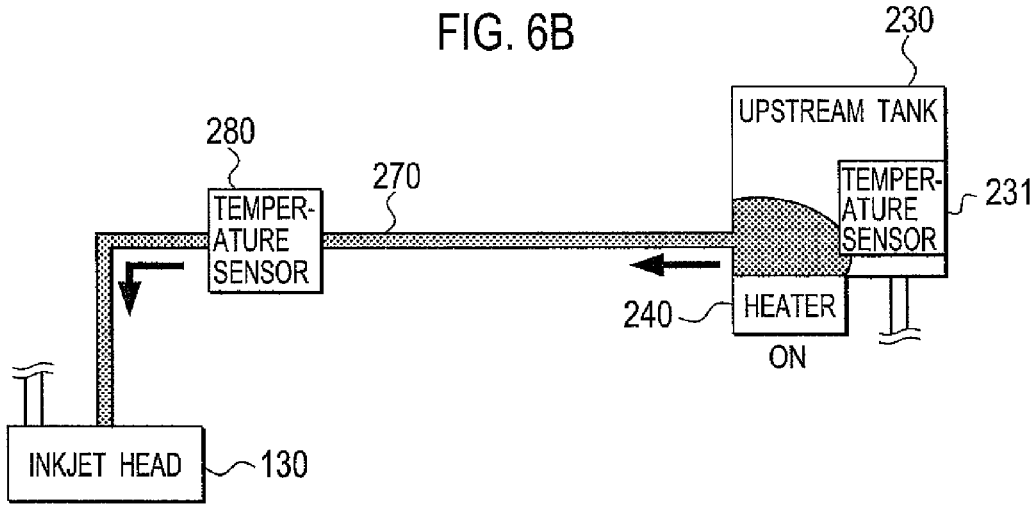

FIG. 6B shows a continuous state in which ink temperatures are kept at a reference value or more, for a prescribed time interval. In this state, there is flux of ink having a temperature equal to or higher than the reference temperature to be supplied to the inkjet head 130, thus allowing for a start of printing.

According to the present embodiment, in a low temperature state, a determination of start of printing depends on a measure of ink temperature at the ink route 270 in which ink flows without stagnation. Accordingly, compared to a case depending on a measure of ink temperature at an ink tank with pooled ink, thus having uneven ink temperatures, the present embodiment allows for a precise estimation of a temperature of flux of ink flowing into the inkjet head 130 and a narrower temperature margin. Therefore, it is possible to have a reduced waiting time for a start of printing due to an ink heating in a low temperature state.

Figure 6C:
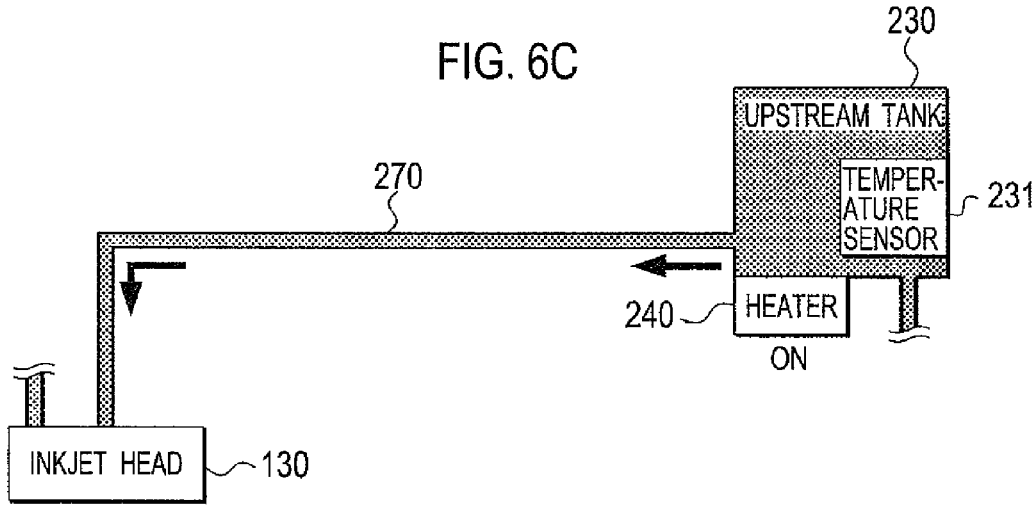

FIG. 6C shows a situation without a temperature sensor installed in the ink route 270, in which a determination of start of printing depends on a conventional measure at the temperature sensor 231 disposed in the upstream tank 230. As shown in FIG. 6B, ink pooled in the upstream tank 230 causes uneven ink temperatures when heated with the heater 240. Accordingly, there is a possible gap to be brought about, between a measure of ink temperature at the temperature sensor 231 and an ink temperature of ink supplied to the inkjet head 130. Therefore, there is the need of setting a wider margin for determination whether or not the ink temperature is raised up to an adequate temperature or more. This leaves no other choices than an interruption of print start until the whole ink circulation route has ink temperatures equal to an adequate temperature or more.

Figure 5:
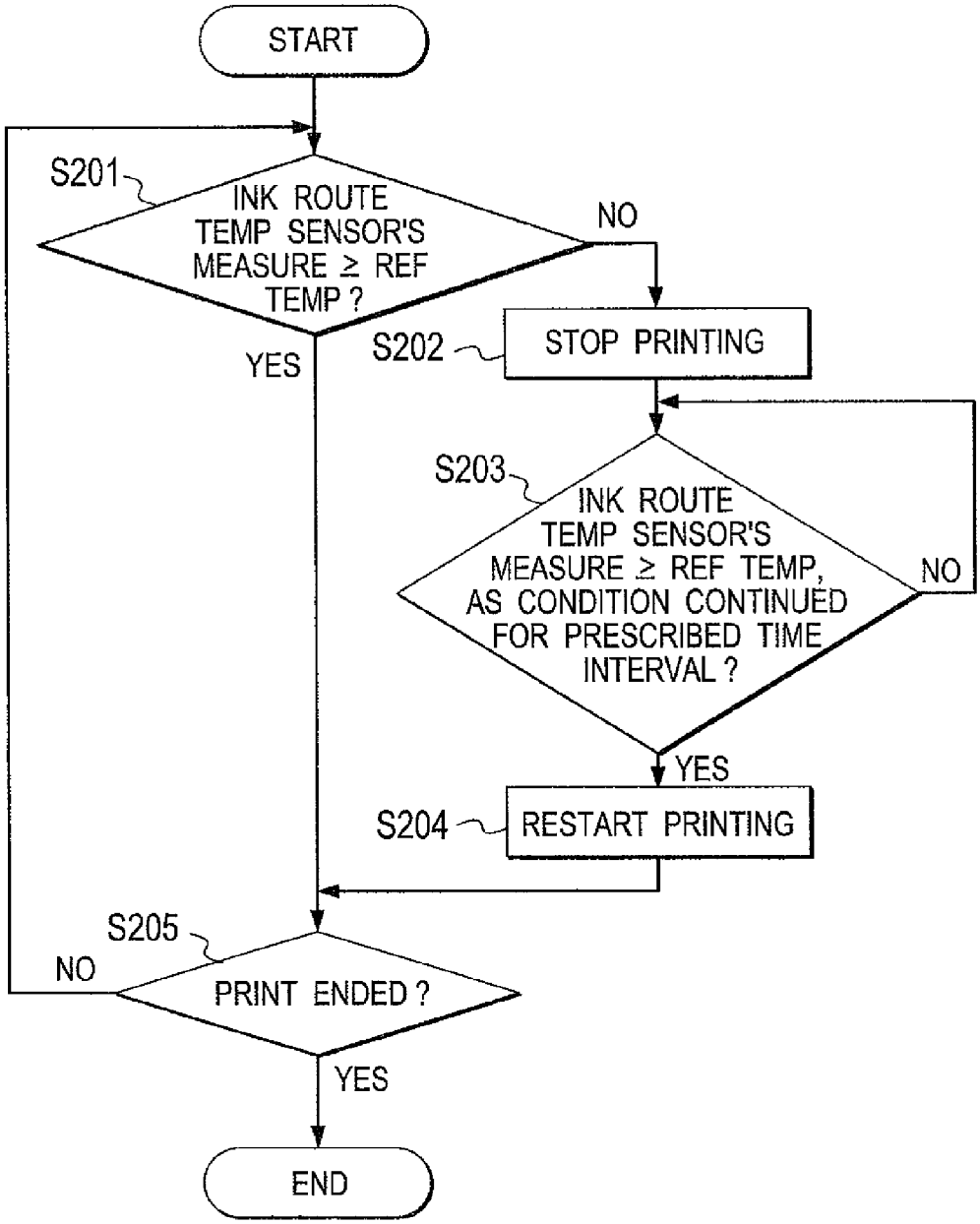
FIG. 5 is a flowchart of control actions in a phase of print execution by the inkjet printer.

Description is now made of actions in a print execution phase by the inkjet printer 10 according to the present embodiment, with reference to a flowchart in FIG. 5. In the execution phase, the temperature controller 111 monitors a measure of ink temperature at the temperature sensor 280 disposed in the ink route 270 between the upstream tank 230 and the inkjet head 130, to determine whether or not a measure of ink temperature at the temperature sensor 280 is kept at the reference temperature or more (S201).

If an ink temperature detected at the temperature sensor 280 is the reference temperature or more (Yes at the S201), the inkjet head 130 is supplied with flux of ink having the adequate temperature, and thus the printing is continued.

Figure 7A:
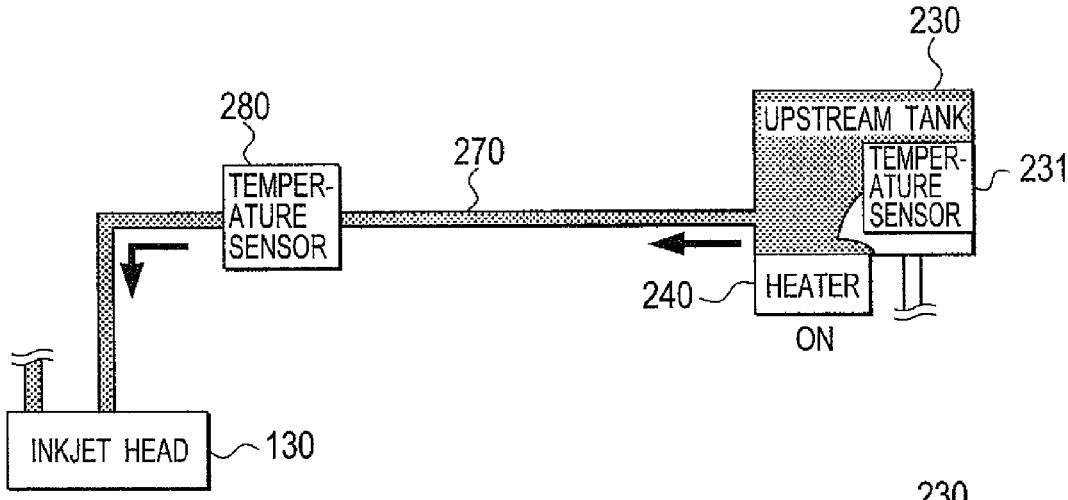
FIGS. 7A, 7B, and 7C are diagrams of ink temperatures in the phase of print execution.

FIG. 7A shows a situation in which a measure of ink temperature at the temperature sensor 280 in the ink route 270 is the reference temperature or more. In this example, the upstream tank 230 however has a flow of ink with low temperatures.

On the other hand, if an ink temperature detected at the temperature sensor 280 becomes lower than the reference temperature (No at the S201), the inlet head 130 is to be supplied with flux of ink having a temperature lower than the reference temperature, and thus the printing is paused (S202). It is not preferable to interrupt a print being made on a sheet, and preferable to stop printing after the print being made is completed. Accordingly, a distance L1 between the temperature sensor 280 and the inkjet head 130 should be equal to or longer than that for ink to travel in the ink route 270 during a time period necessitated for a print on one sheet. This prevents a printing from using ink with temperatures under a reference temperature.

Or, regardless of the distance L1, the following controls may be implemented. That is, when the temperature sensor 280 detects an ink temperature under the reference value on the way of printing, an amount of ink necessitated for a residual printing is estimated per page, based on print ratios, dot number in ink discharge data, or the like. Then, the amount of estimation is compared to an amount of ink from the temperature sensor 280 to the inkjet head 130, and the printing is continued for a printable page or pages, to thereby prevent a print being made on a sheet from being interrupted.

It is noted that a case in which an ink temperature detected at the temperature sensor 280 becomes lower than the reference temperature in the print execution phase is due to a large amount of ink consumption by a printing with a high printing ratio, thus causing a large amount of ink supply at low temperatures from the ink cartridge 210 to the downstream tank 220, etc.

Figure 7B:
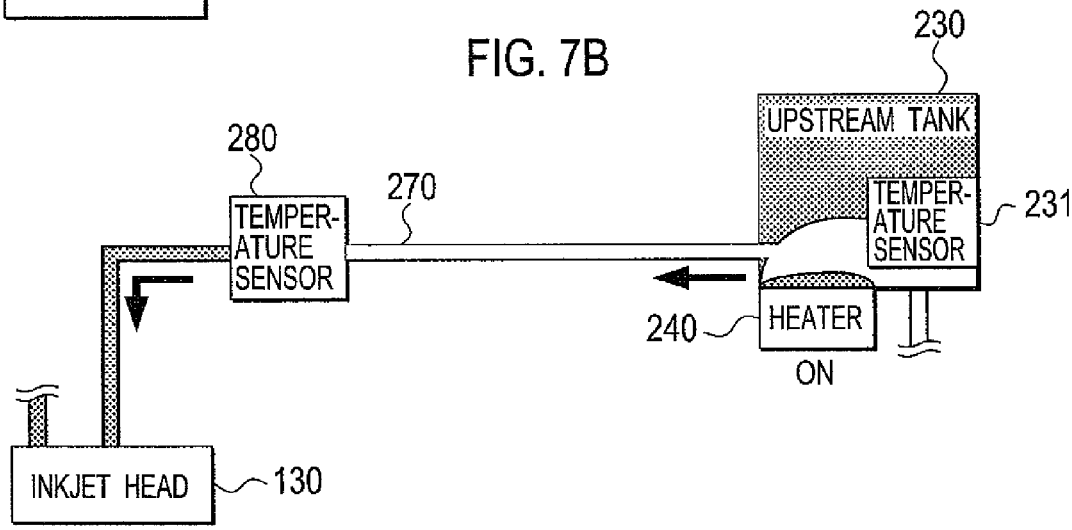

FIG. 7B shows a situation in which an ink temperature detected at the temperature sensor 280 becomes lower than the reference temperature. In this situation, a printing can be however continued while the inkjet head 130 has a flow of ink with a temperature equal to the reference temperature or more.

Figure 7C:
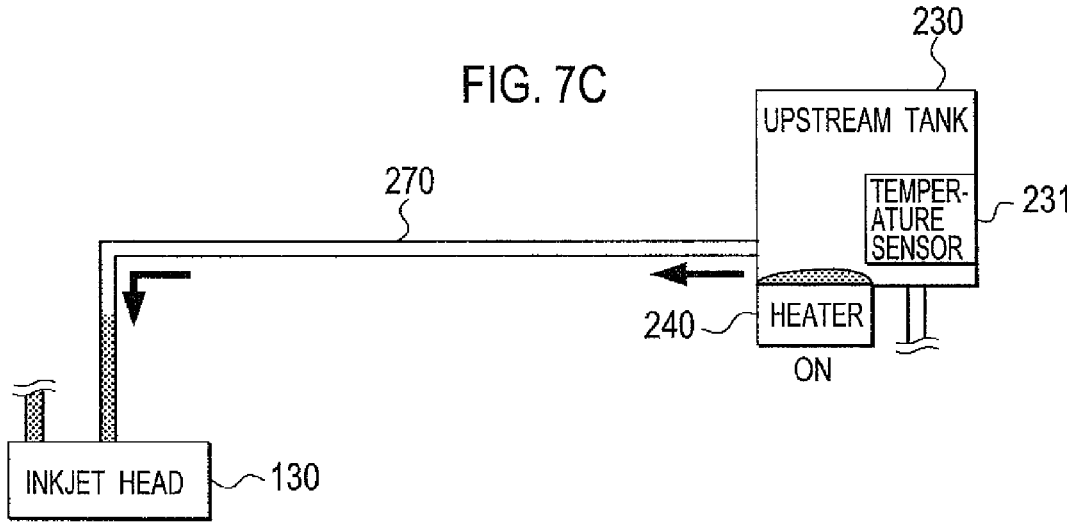

FIG. 7C shows a situation without a temperature sensor installed in the ink route 270, in which a print interruption depends on a conventional measure at the temperature sensor 231 disposed in the upstream tank 230. By the temperature sensor 231 in the upstream tank 230, a precise estimation of temperature of flux of ink flowing into the inkjet head 130 is not possible, thus causing a delayed or unnecessary print interruption.

Back to the description of flowchart in FIG. 5, after a printing is paused, the temperature controller 111 monitors measures of ink temperatures at the temperature sensor 280 disposed between the upstream tank 230 and the inkjet head 130, to determine a continuous state of ink temperatures kept equal to or higher than the reference temperature or not, for the prescribed time interval (S203). The prescribed time interval can be given by the above-noted D1×L1/V1.

It is noted that the temperature controller 111 monitors the temperature sensor 231 disposed in the upstream tank 230 besides the temperature sensor 280. When an ink temperature detected at the temperature sensor 231 becomes lower than the prescribed reference temperature, the temperature controller 111 operates the heater 240 to start heating of ink. When raised up to the reference temperature or more, it operates the heater 240 to stop heating. There may be different values employed for reference temperatures of a start of ink heating and a stop of ink heating, respectively.

If there is a continuous state for the prescribed time interval, in which ink temperatures are kept at the reference value or more by heating (Yes at the step S203), the inkjet head 130 is supplied with flux of ink having the adequate temperature or more, and thus the printing is restarted (S204). There may be a further consideration of a measure of ink temperature at the temperature sensor 133 in the inkjet head 130, to restart a printing. After the restart of printing, the temperature sensor 111 continues monitoring measures of ink temperatures at the temperature sensor 280 (S201) until the end of printing (S205).

As will be seen from the foregoing description, according to the present embodiment, the ink circulation type inkjet printer 10 provides a reduced waiting time for a start of printing due to ink heating in a low temperature state.

Meanwhile, it should be noted in the above-described embodiment that the cross-sectional area of the route between the inlet head 130 and the upstream tank 230 is a function of position, and also the ink circulation amount per unit time in the route between the inkjet head 130 and the upstream tank 230 is a function of time in general. However, the inkjet printer 10 is applicable for such a case to achieve the object of the present invention.

While preferred embodiments of the present invention have been described using specific terms, such description is for illustrative purposes, and it is to be understood that changes and variations may be made without departing from the spirit or scope of the following claims.

The present application claims the benefit of priority under 35U.S.C. §119 to Japanese Patent Application No. 2009-141048, filed on Jun. 12, 2009, the entire contents of which are incorporated herein by reference.

What is claimed is:

1. A printer comprising:

a print head including an ink propelling mechanism;

an ink tank configured to supply ink to the print head;

an ink circulation route including the print head and the ink tank therein;

an ink circulator adapted to circulate ink through the ink circulation route;

a first temperature sensor adapted to measure a temperature of ink flowing in a route between the print head and the ink tank in the ink circulation route;

a heater disposed in a vicinity of the ink tank to heat ink; and a controller configured to work with a received print job, operating for temperatures of ink as measures at the first temperature sensor lower than a first prescribed reference, to heat ink by the heater without starting printing, and for temperatures of ink as measures at the first temperature sensor kept equal to or higher than the first reference for a prescribed time interval, to start printing, wherein the prescribed time interval is defined based on: a distance between the first temperature sensor and the print head; a cross-sectional area of the route between the print head and the ink tank; and an ink circulation amount per unit time in the route between the print head and the ink tank.

2. The printer according to claim 1, wherein the print head further includes an ink chamber to store ink for propelling therein, and the prescribed time interval is defined further based on a volume of the ink chamber.

3. The printer according to claim 1, wherein the controller is adapted to work with a started printing, operating for a temperature of ink as a measure at the first temperature sensor lower than the first reference, to complete a print being made on a sheet, to stop the printing.

4. The printer according to claim 3, wherein the controller is adapted to work with the stopped printing, operating for temperatures of ink as measures at the first temperature sensor kept equal to or higher than the first reference for the prescribed time interval, to restart printing.

5. The printer according to claim 3, wherein the distance between the first temperature sensor and the print head is set longer than that for ink to travel in the route during a printing time necessitated for one sheet.

6. The printer according to claim 1, further comprising;

a second temperature sensor adapted to measure a temperature of ink in the ink head, wherein the controller is adapted to operate for a temperature of ink as a measure at the second temperature sensor lower than a second prescribed reference, not to start printing.

* * * * *